United States Patent [19]

Jung et al.

[11] 4,421,847

[45] Dec. 20, 1983

[54] PROCESS FOR THE CHAIN-LENGTHENING OF GELATINE BY PARTIAL HARDENING

[75] Inventors: Heinrich Jung, Leverkusen; Ulrich Biskup, Cologne, both of Fed. Rep. of Germany

[73] Assignee: Agfa-Gevaert Aktiengesellschaft, Leverkusen, Fed. Rep. of Germany

[21] Appl. No.: 329,731

[22] Filed: Dec. 11, 1981

Related U.S. Application Data

[63] Continuation of Ser. No. 157,464, Jun. 9, 1980, abandoned.

[30] Foreign Application Priority Data

Jun. 13, 1979 [DE] Fed. Rep. of Germany ..... 2924035

[51] Int. Cl.[3] ..... G03C 1/30

[52] U.S. Cl. ..... 430/621; 430/623; 106/125; 260/117; 427/338; 424/360; 426/573

[58] Field of Search ..... 430/621, 623; 260/117; 106/125; 427/338; 424/360; 426/573

[56] References Cited

U.S. PATENT DOCUMENTS

| | | | |
|---|---|---|---|
| 3,100,704 | 8/1963 | Coles | 96/111 |
| 3,103,437 | 9/1963 | Henn | 96/111 |
| 3,619,236 | 11/1971 | Dappen | 117/34 |
| 4,061,499 | 12/1977 | Himmelmann | 96/111 |
| 4,119,464 | 10/1978 | Sauerteig | 96/68 |
| 4,233,398 | 11/1980 | Nittel et al. | 430/621 |

*Primary Examiner*—J. Travis Brown

*Attorney, Agent, or Firm*—Connolly & Hutz

[57] ABSTRACT

In a process for the chain-lengthening of gelatine the gelatine is brought into contact with a hardening agent which can activate the carboxyl groups of the gelatine. The result is a partially hardened gelatine which has advantageous properties as for the production of photographic layers.

13 Claims, 1 Drawing Figure

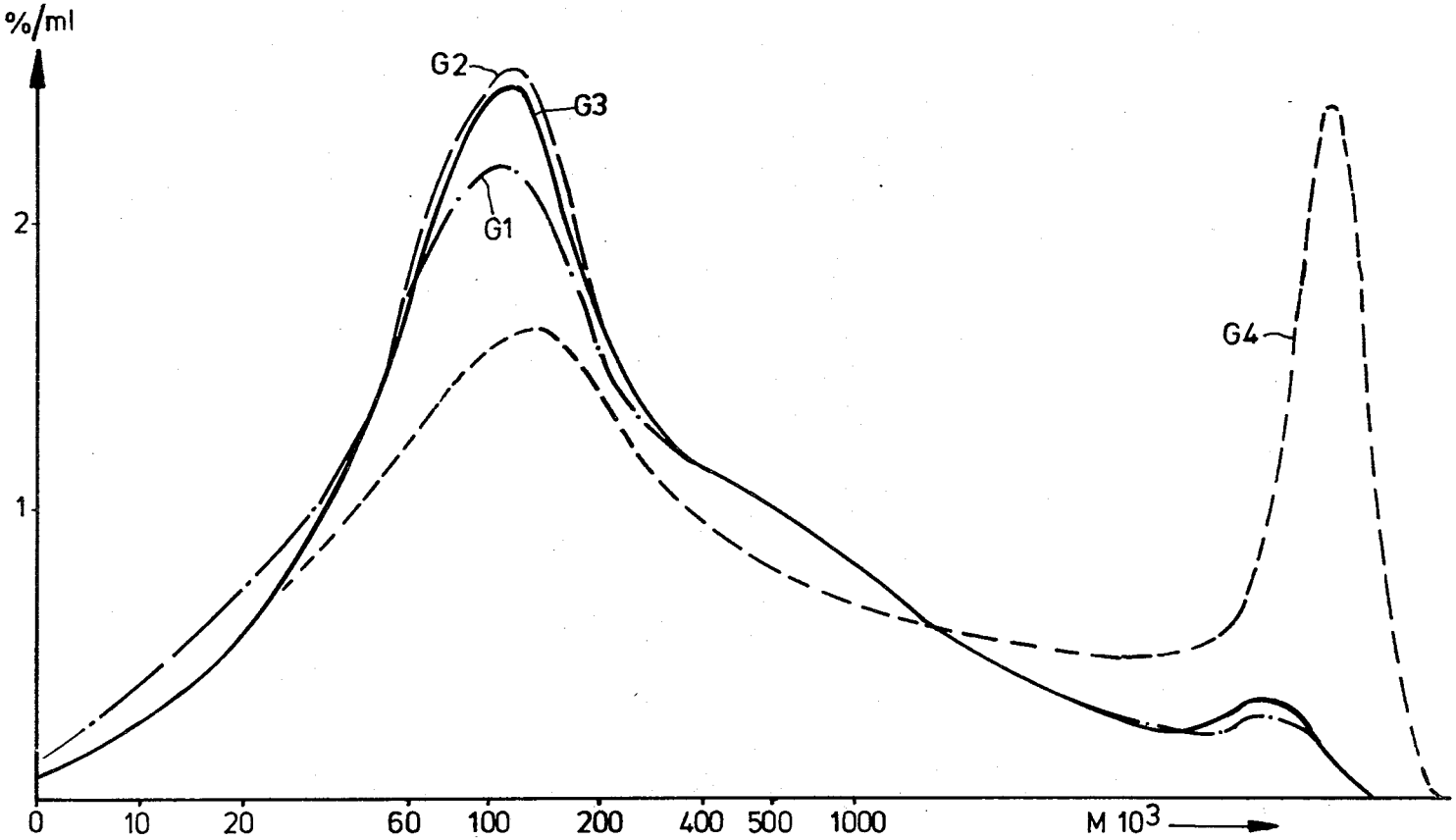
%/ml
2
1
0
10
20
60
100
200
400
500
1000
M 10³
G1
G2
G3
G4

PROCESS FOR THE CHAIN-LENGTHENING OF GELATINE BY PARTIAL HARDENING

CROSS REFERENCE TO RELATED APPLICATIONS

This application is a continuation of copending application Ser. No. 157,464, filed June 9, 1980 by the same inventors, now abandoned.

This invention relates to a process for the chain-lengthening of gelatine by partial hardening by means of a rapid acting cross-linking agent.

The production of photographic layers by casting an aqueous gelatine solution which contains the photographically active components, is generally known from numerous publications and patent specifications. The rate of setting of the cast layers plays an important part, since where the rate of setting is insufficient, the danger of waving by overblowing the gelatine layer arises.

Further, even high grade gelatines are used, sedimentation of the silver halide often sets in, which is attributed to low viscosity of the casting solution. Attempts have been made to overcome these difficulties by adding thickeners e.g. polystyrene sulphonic acid. However the use of thickeners frequently leads to surface defects while casting.

It is known to harden photographic gelatine layers chemically to adjust their degree of swelling and melting point, with the intention of increasing their mechanical strength. The hardening agent is either added to the casting solution or is introduced into these by the subsequent application of a hardening agent solution onto the finished layers.

In the production of photographic layer structures and also in later operations undesirable effects can occur, for example defects in crystallization, difficulties of adhesion or layer separations, which mean that the material is not suitable for use and which to a great extent are to be attributed to the varying lateral swelling of the individual layers. These problems become particularly apparent when, for reasons relating to casting, such short drying times and/or such high drying temperatures have to be used, that the ordered structures of the gelatine layer formation of helices can be only partially formed. Many attempts have been made to overcome these difficulties. It is, for example, usual to add to the casting solutions certain amounts of quickly hardening substances e.g. chrome acetate.

In order to accelerate the rate of solidification, processes have become known which consist in general of the actuation of a hardening reaction, which takes place slowly.

It can be learnt for example from U.S. Pat. No. 2,652,345 that gelatine solutions harden quickly if they contain formaldehyde or the like, and if they are subjected to a gaseous ammonia atmosphere.

It is known from U.S. Pat. No. 2,996,405 that the addition of a mixed styrene-aminomaleic acid polymer similarly during treatment with ammonia vapour causes the desired acceleration in hardening.

Also the reaction gelatine with thiolactones leads to solutions which are stable in the acid range but which on the other hand harden quickly solidify in alkaline media as described in U.S. Pat. No. 3,171,831.

The known processes have the disadvantage that high pH-values which accelerate chemical cross-linking, generally have disadvantages in photographic processes and cannot be used on photographic multilayer materials, since strong cross-linking during the stepwise formation of the material leads to adhesion defects.

It is shown in British Pat. No. 963,772 that limited cross-linking of gelatine or other proteins, e.g. with formaldehyde, improves the flocculation characteristics. In this process however, cross-linking is only carried out at 1 mg as there is no hardening.

An object of the present invention is therefore to provide a gelatine, in particular a gelatine which is suitable for the production of photographic layers, which has improved setting rate behaviour and which when used as a binding agent, can be cast into layers without the defects which are caused by reticulation, the interferring formation of sediments and without crystallization defects even, where high casting velocities are used.

According to the invention, the problem is reduced or substantially solved by a process for the chain-lengthening of gelatine by partial cross-linking, which is characterized in that a gelatine solution, which contains at least 5% by weight gelatine, is brought into contact with 0.001 to 0.01 mole of a hardening agent per 100 g dry gelatine for 0.01 seconds to 10 minutes at 30° to 90° C.; the hardening agent being one which can activate the carboxyl groups of the gelatine and convert a 20 μm thick dry gelatine layer, if this is coated with a layer of an aqueous solution of the hardening agent at a concentration of 0.01 to 0.03 mole of the hardening agent per 100 g dry gelatine at a pH-value of the moist gelatine layer of 5 to 7 and an material temperature of 20° C., into a layer of gelatine which is resistant to boiling and no longer subsequently hardens, after 3 to 6 minutes.

Casting solutions produced from the gelatine according to the invention have an increased setting rate (shorter setting time) and an increased viscosity so that casting defects and the formation of a sediment can be extensively avoided. Photographic multilayer materials with improved properties can be manufactured using the gelatine, according to the invention because of decreased lateral swelling of the individual layers, so that crystallization defects are suppressed. These effects result from the chain-lengthening of the gelatine.

Chain-lengthening of the gelatine is achieved by mixing a gelatine solution in as concentrated form as possible homogeneously with a suitable hardening agent. This mixing must be carried out in a short time relative to with the reaction time of the hardening agent used. The quantity of the hardening agent is chosen so that the resulting reaction product remains soluble or can be redissolved after setting. For gelatines with high Bloom-values, hardener quantities of 0.6%, based on the gelatine, are sufficient.

It is in principle also possible to carry out chain lengthening by the addition of corresponding amounts of a hardening agent to a gelatine dispersing agent in hydrophobic phase and then mixing the dispersing agent with an unmodified gelatine.

A preferred embodiment of the process according to the invention comprises processing an aqueous gelatine solution, keeping the concentration of the gelatine higher than 5% by weight, preferably higher than 10% by weight. Excellent results are obtained with concentrations of 10 to 30% by weight. The amount of the hardening agent which is used should preferably be chosen to be sufficient that either no or poly one insoluble gelatine reaction product is obtained. In general, good results are obtained with 0.01 to 0.001 mole, particularly 0.008 to 0.002 mole, of hardener per 100 g gelatine or, expressed differently, with 3 to 0.3% by weight, preferably 2.4 to 0.6% by weight of the hardening agent, based on the dry weight of the gelatine.

The optimum amount of hardener depends on the type of gelatine (molecular weight) and on the chemical nature of the hardener. This can easily be established by simple experiments.

The treatment time of the gelatine with the hardening agent, depends on the temperature and the hardener used, and is in the range of approximately 0.01 seconds to 10 minutes. In the working area which is of practical interest, good results are obtained with reaction times of 5 to 200 seconds are preferably 7 to 100 seconds. The treatment temperature is from 30° to 90° C., preferably 30° to 60° C.

The chain-lengthening reaction can be accelerated by stirring the reaction solution intensively. The treatment of the gelatine according to the invention can be carried out advantageously in the presence of surface-active compounds such as Na-dodecyl sulphate. Suitable quantities of such surface-active compounds are from 1 to 6% by weight, based on the gelatine.

After the chain lengthening reaction, the resulting product can be diluted to the desired concentration directly in a suitable mixing aggregate. However, it is also possible first of all to dry the reaction product, to size-reduce it to small pieces and at a later time to swell it in the usual way and to dissolve it by stirring.

As the starting substance for the production of the gelatines, gelatine qualities which meet the usual requirements for the production of photographic layers are particularly suitable. The gelatines which are produced from these gelatines by the methods according to the invention, differ in a very advantageous way from their starting products, in the rate of setting and the viscosity of the casting solutions produced from them as well as in the lateral swelling of dried layers.

Gelatines can of course also be obtained from lower-quality starting materials in the way described having clearly improved setting behaviour and increased viscosity.

For chain-lengthening of the gelatine, all peptide reagents which are known to react quickly in aqueous solutions and which are also known in the photographic industry as fast-acting hardening agents, are suitable. By the term "fast-reacting peptide reagents", are to be understood compounds which can react with gelatine in an aqueous solution within a few minutes, with molecular enlargement of the gelatine. This reaction takes place with the formation of a new peptide compound. The compounds are also known as hardening agents which activate carboxyl groups.

The compounds which activate carboxyl groups are hardening agents which do not act directly on the amino groups of the gelatine, but react with the carboxyl groups of the gelatine with the formation of reactive intermediate products of the activated ester or anhydride type, which reactive intermediate products react further with the amino groups of the gelatine with cross-linking, to form isopeptide compounds.

The hardening agents used according to the invention are so-called rapid hardening agents, which are the hardening agents which activate the carboxyl groups of the gelatine. It is a characteristic of these rapid hardening agents that photographic gelatine layers which are treated with them resistant to boiling and do not subsequently harden when, after casting and drying, they have left the casting apparatus.

If, for example a 20 μm thick dry gelatine layer is coated with a layer of the aqueous solution of a rapid hardening agent such that 0.01 to 0.03 mole of the hardening agent per 100 g dry gelatine are applied, and the pH value of the gelatine layer which is still moist, is 5–7, then at a material temperature of 20° C., after 3 to 6 minutes, a boiling-resistant layer is obtained which is no longer subsequently hardening.

A rapid hardening agent is suitable for use according to the invention if according to the above test;

1. The melting point of the layers immediately after casting the hardening solution and after drying (fresh sample) is $\geqq 100°$ C.

2. The swelling factor of the fresh sample, in comparison with a sample which has been stored for 7 days after manufacture at 30° C. and with 85% relative humidity (storage sample) is changed at the most by 10%. By the term swelling factor, the ratio of the layer thickness swollen at 38° C. (after 10 minutes swelling time) to the dry layer thickness is understood.

If the swelling factor of the fresh sample is characterized by $Q_a$ and the swelling factor of the storage sample is characterized by $Q_t$ then according to this definition there is no subsequent hardening, when $$Q_a/Q_t = 1 \pm 0.1$$

In this case, the hardening agent which is used is a rapid hardening agent. However, there is subsequent hardening when it is true that:

$$Q_a/Q_t \geqq 1.1.$$

The hardening agent which is used is then not a rapid hardening agent in the meaning of the present invention.

The reaction of gelatine with fast acting hardening agents is known per se. If gelatine layers are coated with a layer of an aqueous solution of this fast acting hardening agent, then hardened gelatine layers are obtained which no longer dissolve in hot water. The layers are irreversibly cross-linked.

It is also known that intramolecular or intracaternary cross-linking can be carried out in dilute aqueous solutions (<5% by weight gelatine) with the same cross-linking agents. By this is understood cross-linking within a single gelatine molecule which is present in random coil configuration. By such cross-linking, gelatine derivatives are obtained, which have lost their gelling characteristics and the characteristics of layer formation on drying. They can no longer be used for photographic purposes, but can be used for example as a blood plasma substitute. (Gardi, Mitschmann, Helv. Chimica Acta 55 (1972) pages 2463–2486).

By the term "helixificated form", is meant, a partial plasma conversion of the gelatine molecule while cooling. Helixification is important for gel formation.

In using the higher gelatine concentration according to the invention of 5 to approximately 35% by weight in water, and by using the quantity of hardening agent according to the invention and the stated temperature, the required intermolecular (intercaternary) bonds are obtained which lead predominantly to an increase in the molecular weight by linear chain-lengthening, without adversely affecting the tendency towards triple helix formation. Bu the term triple helix formation, the partial conversion of random coils into ordered spiral areas, which consist of three single stranded helices, is understood.

By increasing the molecular weight without substantially impairing the structure, gelatine derivatives are obtained having higher gelling rates. The viscosity of aqueous solutions produced from them is increased and the lateral swelling in layers cast from them is reduced.

The occurrence of predominantly linear chain lengthening would not have been expected. It only occurs with aqueous solutions containing 5 to 35% by weight of gelatine. with higher concentrations of gelatine, the gelatine cross-links ineversibly and can no longer be homogeneously melted.

With lower concentrations (<5% by weight) a large proportion of intramolecular bonds are obtained, and these, give the gelatine poor gelling and physical characteristics.

The structural forms can be determined by analytical measurement.

FIG. 1 shows the gel chromatograms of 3 bone gelatines compared to a gelatine which was treated according to the process of the invention.

The designations of the curves shown in FIG. 1 have the following meaning.

G1: A desalted bone gelatine
G2: A second desalted bond gelatine
G3: A salted gelatine
G4: A chain lengthened gelatine with an increased micro gel content, produced from gelatine G2.

In all cases, there is a broad molecular weight distribution having a maximum of approximately 120,000. Moreover, in the void volume a very high molecular weight fraction appears which is subsequently identified as a microgel. In the starting products, this fraction amounts to 3 to 4.5%, and it increases by chain lengthening to more than 20% (curve G4). The gelatine obtained by the process of the invention has a microgel content of up to 40%.

A more exact analysis of the microgel can be carried out by viscosimetric measurements in solution, and this is done before and after double centrifuging. The ratio g of the viscosity numbers of the sample to the viscosity number of a linear standard was determined. The deviation of the figure g from the value 1 is a measure of the deviation of the sample from a linear structure.

TABLE

| Sample | not centrifuged g | after double centrifuging g |
|---|---|---|
| Starting gelatine | 0.17 | 0.50 |
| Microgel-gelatine according to the invention | 0.12 | 0.31 |

It follows that the microgel fraction of the gelatine treated according to the invention has a substantially more linear structure than the natural microgel fraction of the starting gelatine.

Relatively linear chain lengthening has therefore taken place preferentially.

Fast acting hardening agents which are particularly suitable for the process of the invention include carbamoylonium salts, carbamoyloxypyridinium salts; carbodiimides; sulphobetaine carbodiimides; 1-N-ethoxycarboxy-2-ethoxydihydroquinolines; isoxazolium salts; bis-isoxazolium salts and diisocyanates. Examples of such hardening agents are compounds which correspond to the following general formulae:

(1) Carbamoylonium compounds of the formula

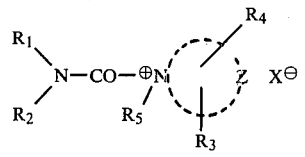

in which:

$R_1$ represents an alkyl group which may be substituted, preferably an alkyl group having 1 to 3 carbon atoms; an aryl group which may be substituted by a secondary alkyl radical or by halogen, e.g. phenyl, which may be substituted by methyl, ethyl, propyl, chlorine or bromine or an aralkyl group e.g. benzyl, which can be substituted in the same way as the aryl group.

$R_2$ may have the same definition as $R_1$, or may also represent a divalent substituted or unsubstituted alkylene, arylene, aralkylene, or alkyl-aryl-alkylene radical e.g. an ethylene, propylene, phenylene or xylylene radical, which, via its second bond, is connected with another carbamoyl ammonium group of the formula

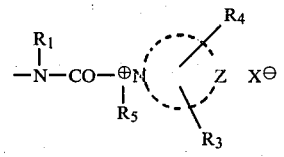

or $R_1$ and $R_2$ may together represent the atoms necessary to complete a substituted or unsubstituted piperidine, piperazine or morpholine ring, which ring can be substituted for example by an alkyl group having 1 to 3 carbon atoms or by halogen such as chlorine or bromine;

$R_3$ represents a hydrogen atom and may also represent an alkyl group having 1 to 3 carbon atoms or the group $\text{-}[A]\alpha$, in which A represents a vinyl group of a polymerised vinyl compound or of a mixed polymer with other monomers which can be copolymerised and $\alpha$ represents a number such that the molecular weight of the compound is greater than 1000;

$R_4$ represents a hydrogen atom, or may also represent an alkyl group having 1 to 3 carbon atoms or, if Z represents the atoms necessary to complete a pyridinium ring and $R_3$ is missing, then $R_4$ represents one of the groups:

$-NR^6-CO-R^7$ in which $R^6$=H,alkyl (1 to 4 C)
$R^7$=H,alkyl (1 to 4 C); $=NR^8R^9$ and
$R^8,R^9$=H,alkyl ($C_1$-$C_4$);

$-(CH_2)_m-NR^{10}R^{11}$ in which $R^{10}=-CO-R^{12}$
$R^{11}$=H,alkyl ($C_1$-$C_4$)
$R^{12}$=H,alkyl ($C_1$-$C_4$)
$R^{12}=NR^{13}R^{14}$
$R^{13}$=alkyl ($C_1$-$C_4$), aryl
$R^{14}$=H,alkyl, aryl and
m=1-3;

$-(CH_2)_n-CONR^{15}R^{16}$ in which $R^{15}$=H,alkyl ($C_1$-$C_4$), aryl $R^{16}$=H,alkyl ($C_1$-$C_4$) or $R^{15}$ and $R^{16}$ together represent the atoms necessary to complete a 5- or 6-membered aliphatic ring and n=0 to 3; or

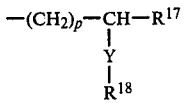

in which $R^{17}$=H, alkyl ($C_1$-$C_4$), which may be substituted by halogen

Y=—O—, —$NR^{19}$—

$R^{18}$=H, alkyl, —CO—$R^{20}$, —CO—$NHR^{21}$ $R^{19}$,$R^{20}$,$R^{21}$=H,alkyl ($C_1$-$C_4$)

and p=2 to 3;

$R_5$ represents alkyl, aryl or aralkyl, but $R_5$ is missing if the nitrogen to which $R_5$ is bound carries a double bond in the heterocyclic aromatic ring which is formed by Z;

Z represents the atoms necessary to complete a substituted or unsubstituted, 5- or 6-membered heterocyclic nitrogen-containing aromatic ring or a condensed system e.g. isoquinoline, and may contain other hereto atoms e.g. O and S, besides the nitrogen atom and X represents an anion, e.g. halide⊖, $BF_4$⊖, $NO_3^{\Gamma}$, $SO_4$⊖, $ClO_4$⊖ or $CH_3OSO_3$⊖.

(II) Carbamoyl pyridinium compounds of the formula:

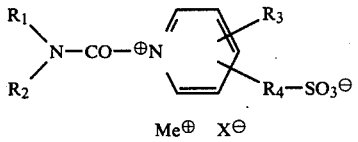

in which:

$R_1$ and $R_2$ which may be the same or different, represent an alkyl group having 1 to 3 carbon atoms, or an aryl group which may be substituted by a secondary alkyl radical or by halogen, e.g. phenyl, which may be substituted by methyl, ethyl, chlorine or bromine or may represent an aralkyl group e.g. benzyl, which can be substited in the same way as the aryl group, or $R_1$ and $R_2$ may together represent the atoms necessary to complete a piperdine or morpholine ring, which ring can be substituted by alkyl, for example, methyl or ethyl, or by halogen, for example, chlorine or bromine;

$R_3$ represents hydrogen, methyl or ethyl, $R_4$ represents methylene, ethylene or propylene, or a simple chemical bond.

Me⊕ represents an alkali metal cation such as Li⊕, Na⊕ or K⊕ and

X⊖ represents an anion such as chlorine or bromine.

(III) Carbamoyloxy pyridinium compounds of the formula

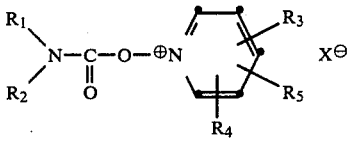

in which:

$R_1$ represents alkyl having 1 to 3 carbon atoms or aryl, such as phenyl;

$R_2$ represents alkyl with 1 to 3 carbon atoms or the group

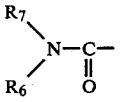

in which:

$R_7$ represents hydrogen or alkyl such as methyl or ethyl and $R_6$ represents alkyl such as methyl or ethyl, or $R_1$ and $R_2$ may together represent the atoms necessary to complete a heterocyclic ring such as a pyrrolidine; morpholine; piperidine; perhydroazepine; 1,2,3,4-tetrahydroquinoline or imidazolidine-2-OH ring, or $R_1$ and $R_2$ may together represent the atoms necessary to complete a piperazine ring, which is bonding via its second nitrogen atom to a similar second molecular grouping corresponding to the general formula (III);

$R_3$ represents hydrogen, halogen such as chlorine or bromine, alkyl such as methyl or ethyl, oxyalkyl having 1 to 3 carbon atoms, cyan, —$CONH_2$ or —N—H—C—O—alkyl such as methyl or ethyl;

$R_4$ represents hydrogen, alkyl such as methyl or ethyl;

$R_5$ represents hydrogen or methyl; and

X represents anion such as Cl⊖, $BF_4$⊖, or $ClO_4$⊖.

(IV) Carbodiimides of the formula $$R_1—N=C=NR_2$$

in which:

$R_1$ and $R_2$ which may be the same or different, represent alkyl such as methyl, ethyl, n-propyl, isopropyl, n-butyl, sec.-butyl, iso-butyl, tert.-butyl, amyl, hexyl or cyclohexyl; alkoxyalkyl such as methoxy- or ethoxyethyl, propyl or amyl; aryl such as phenyl, benzyl or phenylethyl; ethylmorpholinyl, diethylaminoethyl, ethylpyridyl, α-, b- and γ-methyl or ethylpyridyl or $R_1$ represents alkyl having 1 to 5 carbon atoms and $R_2$ represents the group:

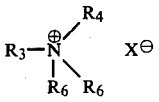

in which $R_3$ represents alkylene having 1 to 5 carbon atoms, $R_4$ and $R_5$ represent alkyl having 1 to 3 carbon atoms or $R_4$ and $R_5$ may together form a 6-membered heterocyclic ring with 1 or 2 hetero atoms, e.g.

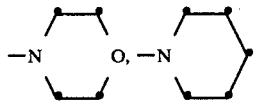

$R_6$ represents hydrogen or a secondary alkyl group and X represents an anion such as chloride bromide or toluene sulphonate.

(V) Sulphobetain-carbodiimides of the formula:

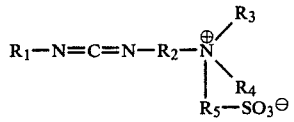

in which:

$R_1$ represents alkyl having 1 to 6 carbon atoms, cycloalkyl or alkoxyalkyl;

$R_2$ represents alkylene having 2 to 4 carbon atoms;

$R_3$ represents alkyl having 1 to 3 carbon atoms;

$R_4$ represents alkyl having 1 to 3 carbon atoms or aryl, such as phenyl or $R_3$ and $R_4$ may together represent the atoms required to complete a 6-membered heterocyclic ring, which can contain other heteroatoms apart from the N-atom, such as piperidine, piperazine, or morpholine and $R_5$ represents alkylene having 1 to 4 carbon atoms.

(VI) Dihydro quinolin derivatives of the formula

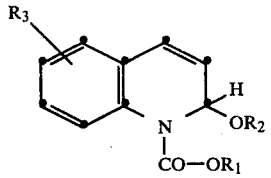

in which:

$R_1$ represents alkyl having 1 to 4 carbon atoms, which may be unsubstituted or substituted by alkyloxy, e.g. methoxy or ethyoxy, or by halogen e.g. by chlorine or bromine;

$R_2$ represents alkyl having 1 to 4 carbon atoms, which may be unsubstituted by alkyoxy, e.g. methoxy or ethyoxy; halogen, e.g. chlorine, dialkylamino or trialkylammonium, e.g. dimethylamino; diethylamino, trimethylammonium or triethyl ammonium; aryl, e.g. phenyl, or by alkylsulphonyl, e.g. methylsulphonyl or ethylsulphonyl or $R_2$ represents, when $R_3$ is missing,

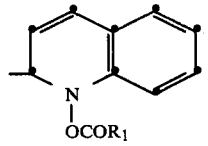

$R_3$ represents hydrogen, halogen, e.g. chlorine or bromine, alkoxy, e.g. methoxy or alkoxy or alkyl, e.g. methyl, ethy. or propyl.

(VII) Isoxazolium salts of the formula

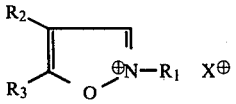

in which:

$R_1$ represents an aliphatic hydrocarbon radical having 1 to 4 carbon atoms, which can contain a sulphonate anion, $R_2$ and $R_3$ represent hydrogen, unsubstituted alkyl; unsubstituted aryl; alkyl or aryl substituted by halogen, hydroxy, alkyl, alkoxy and/or a sulphonate-anion, or represent a simple heterocyclic ring e.g. furyl, or $R_2$ and $R_3$ may together represent an alicyclic ring;

X represents an anion, which makes the compound soluble in water, such as perchlorate or, p-toluene sulphonate, or X is missing, if $R_1$ $R_2$ or $R_3$ already contain a sulphonate anion.

(VIII) Bis-isoxazoles and their quaternary salts of the formulas:

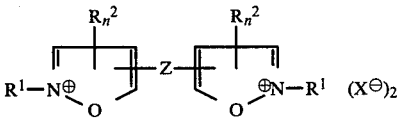

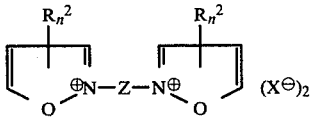

in which:

Z represents a bifunctional aliphatic or aromatic radical;

$R_1$ represents an aliphatic hydrocarbon radical having 1 to 4 carbon atoms;

$R_2$ represents alkyl, cycloalkyl or aryl, if $R_2$ is not bound at the 3-position in the ring, n represents 0,1 or 2 and X represents an anion such as perchlorate, p-toluene sulphonate, chloride or tetrafluoroborate.

(IX) Diisocyanates of the formula

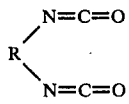

in which:

R represents an alkylene group having 1 to 6 carbon atoms, an arylene group which may be substituted or a cycloaliphatic radical, such as cyclohexyl, which may be substituted.

The following are examples of rapid hardening compounds according to the formulae I to 4;

Compounds according to formula I

| | | |
|---|---|---|
| I/1. | 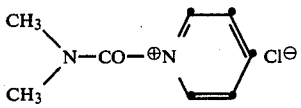 | syrup very hygroskopic |

-continued
| | | |
|---|---|---|
| I/2. | 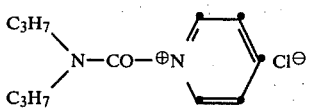 | syrup very hygroskopic |
| I/3. | 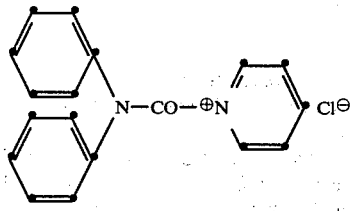 | Fp. 112° C. |
| I/4. | 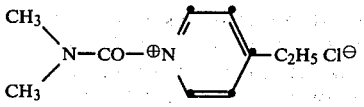 | Fp. 103° C. |
| I/5. | 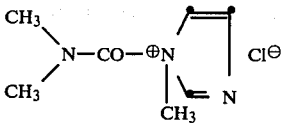 | Fp. 87–89° C. |
| I/6. | 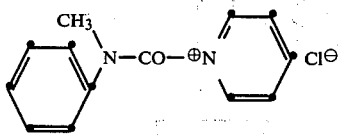 | Fp. 108–110° C. |
| I/7. | 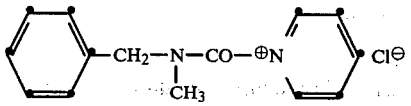 | syrup, hygroskopic |
| I/8. | 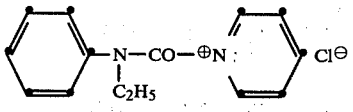 | Fp. 105–107° C. |
| I/9. | 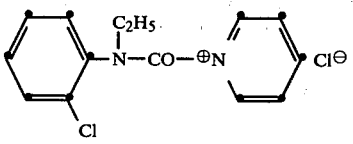 | syrup |
| I/10. | 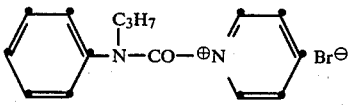 | Fp. 103–105° C. |
| I/11. | 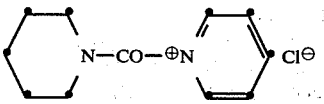 | Fp. 75–77° C. |
| I/12. | 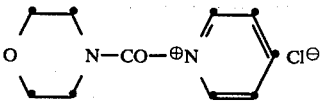 | Fp. 110–112° C. |

-continued
| | | |
|---|---|---|
| I/13. | 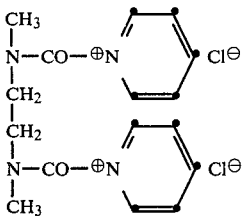 | Fp. 95–96° C. |
| I/14. | 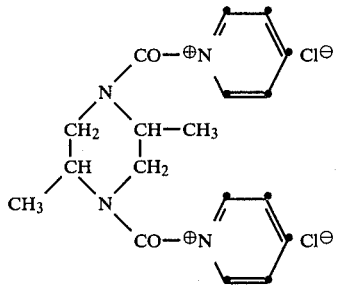 | Fp. 106° C. |
| I/15. | 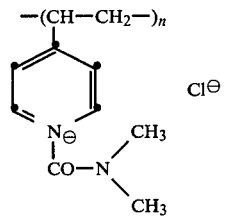 | mol weight above 1000 |
| I/16. | 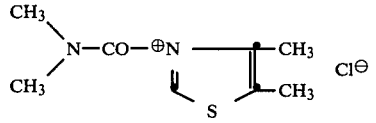 | Fp. 66–68° C. |
| I/17. | 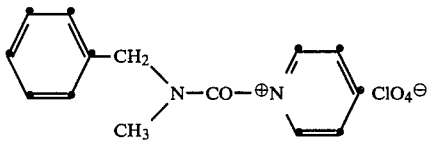 | syrup, hygroskopic |
| I/18. | 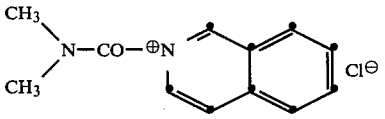 | Oil |
| I/19. | 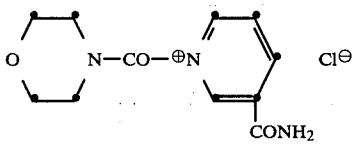 | Fp.: 103–105° C. |
| I/20. | 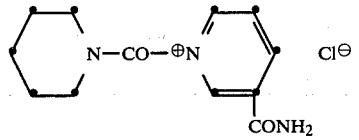 | Oil |
| I/21. | 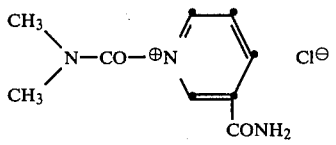 | Fp.: 109° C. |

-continued
I/22. 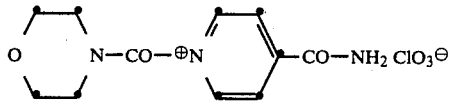
I/23. 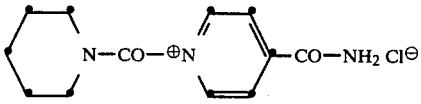 Oil
I/24. 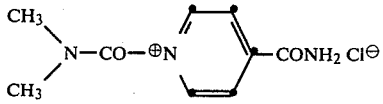 Fp.: 115° C.
I/25. 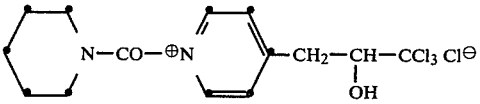 Fp.: 154° C.
I/26. 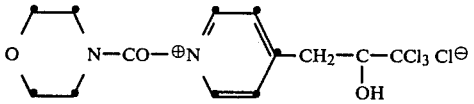 Fp.: 140° C.
I/27. 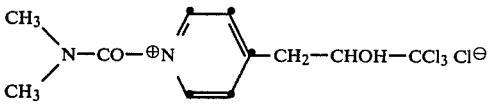 Fp.: 115° C.
I/28. 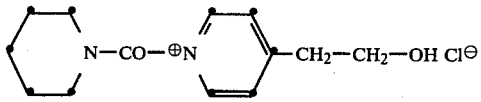
I/29. 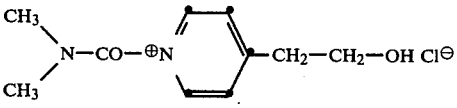 Fp.: 140–145° C.
I/30. 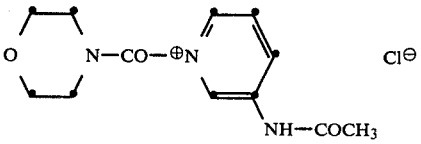 Fp.: 118–120° C.
I/31. 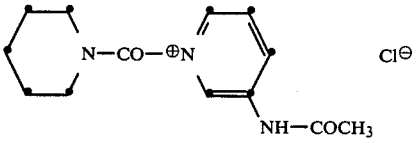 Fp.: 90° C.
I/32. 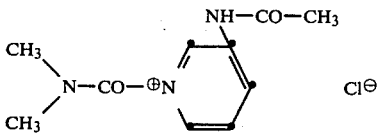 Fp.: 210° C.
I/33. 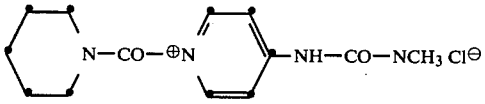 Fp.: Oil -continued
| | | |
|---|---|---|
| I/34. | 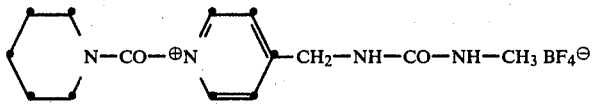 | Oil |
| I/35. | 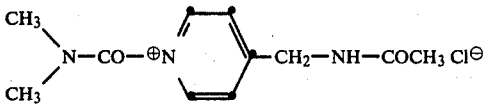 | Oil |
| I/36. | 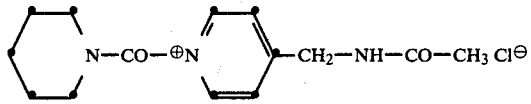 | Oil |
| I/37. | 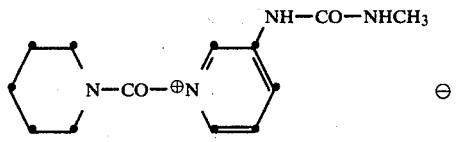 | Fp.: 60–65° C. |
| I/38. | 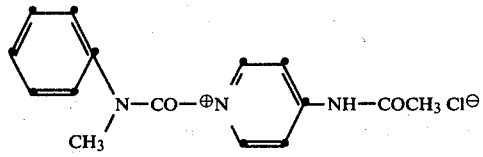 | |
| I/39. | 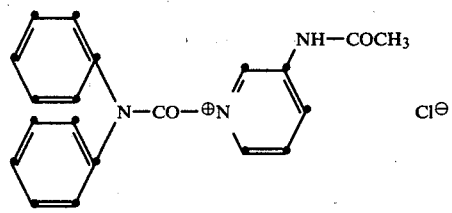 | |
| I/40. | 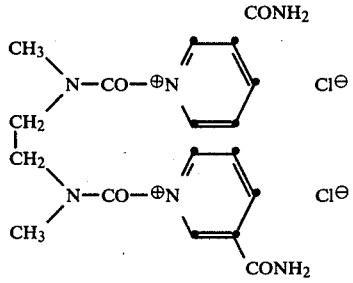 | |
Compounds according to formula II
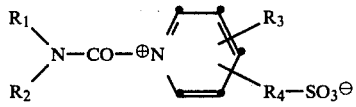
$Me^{\oplus}X^{\ominus}$
II/1. 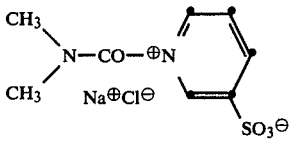
-continued
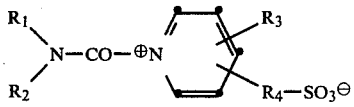
$Me^{\oplus}X^{\ominus}$
II/2. 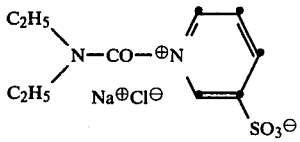

-continued
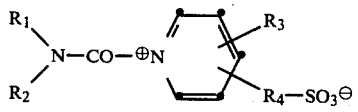
$Me^{\oplus}X^{\ominus}$
II/3.
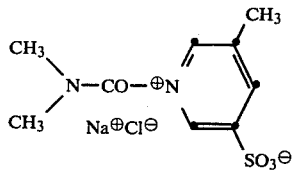
II/4.
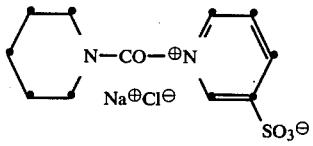
II/5.
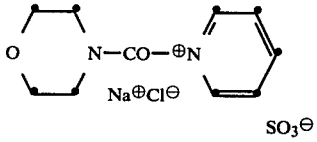
II/6.
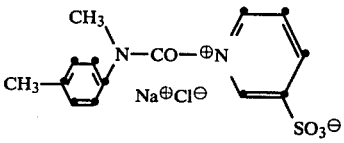
II/7.
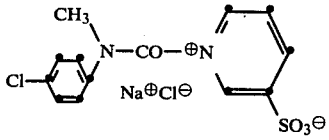
II/8.
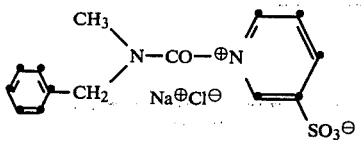
II/9.
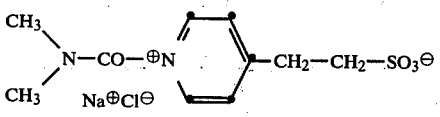
II/10.
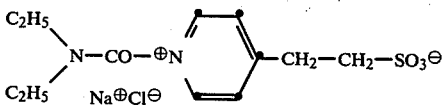
-continued
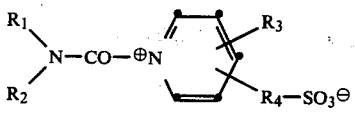
$Me^{\oplus}X^{\ominus}$
II/11.
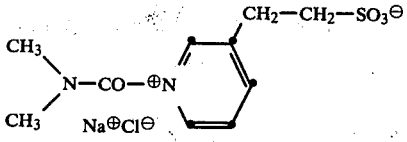
II/12.
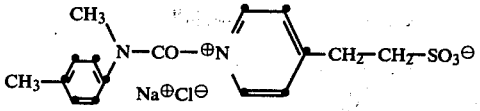
II/13.
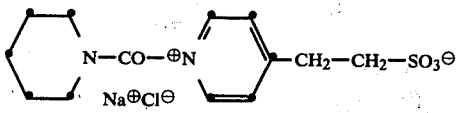
II/14.
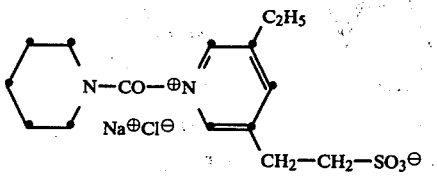
II/15.
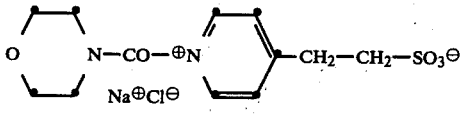
II/16.
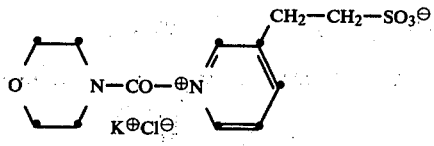
II/17.
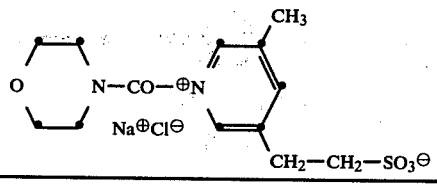
Compounds according to formula III

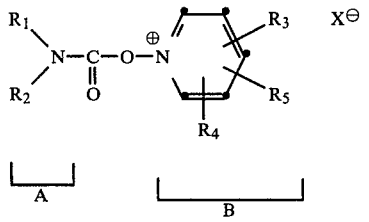
| Subst. Nr. | A | B | $X^{\ominus}$ | Fp. decomp. |
|---|---|---|---|---|
| III/1. | 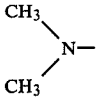 | 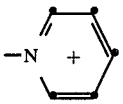 | $Cl^{\ominus}$ | 163–67° |
| III/2. | " | 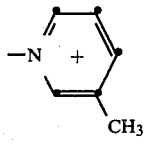 | $Cl^{\ominus}$ | 168–70° |
| III/3. | " | 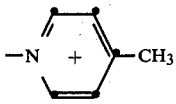 | $Cl^{\ominus}$ | 85° |
| III/4. | " | 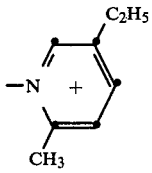 | $Cl^{\ominus}$ | 90° |
| III/5. | " | 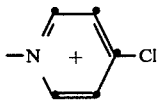 | $ClO_4^{\ominus}$ | 100–102° |
| III/6. | " | 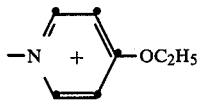 | $ClO_4^{\ominus}$ | 95–100° |
| III/7. | " | 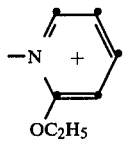 | $ClO_4^{\ominus}$ | 100–102° |
| III/8. | 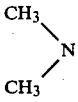 | 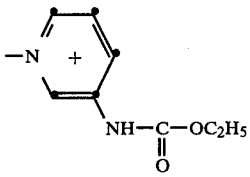 | $ClO_4^{\ominus}$ | 150° |
| III/9. | 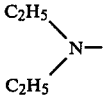 | 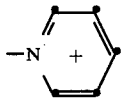 | $Cl^{\ominus}$ | 108–110° |

-continued
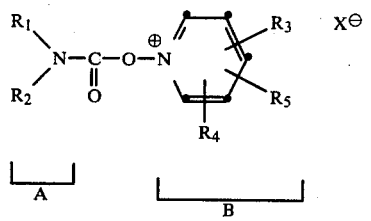
| Subst. Nr. | A | B | $X^{\ominus}$ | Fp. decomp. |
|---|---|---|---|---|
| III/10. | " | 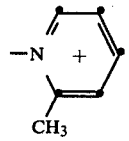 | $ClO_4^{\ominus}$ | 64–65° |
| III/11. | " | 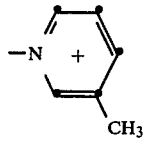 | $ClO_4^{\ominus}$ | 130–32° |
| III/12. | " | 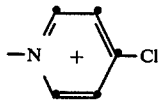 | $Cl^{\ominus}$ | 95–100° |
| III/13. | 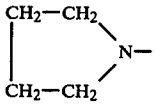 | 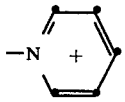 | $Cl^{\ominus}$ | 114–115° |
| III/14. | " | 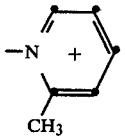 | $Cl^{\ominus}$ | 90–92° C. |
| III/15. | 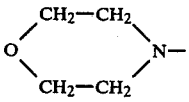 | 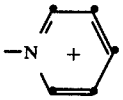 | $Cl^{\ominus}$ | 132° C. |
| III/16. | " | " | $BF_4^{\ominus}$ | 138–40° C. |
| III/17. | " | " | $ClO_4^{\ominus}$ | 150–52° C. |
| III/18. | " | 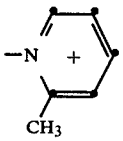 | $Cl^{\ominus}$ | 110–13° C. |
| III/19. | " | " | $ClO_4^{\ominus}$ | 140–43° C. |
| III/20. | " | 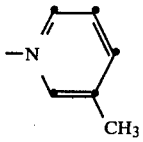 | $Cl^{\ominus}$ | 130–32° C. |

-continued
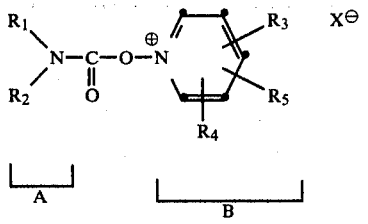
| Subst. Nr. | A | B | X⊖ | Fp. decomp. |
|---|---|---|---|---|
| III/21. | " | 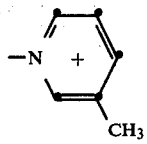 | $ClO_4^{\ominus}$ | 144–46° |
| III/22. | 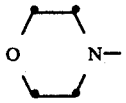 | 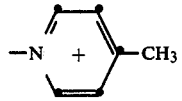 | $Cl^{\ominus}$ | >90° |
| III/23. | " | 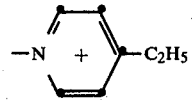 | $Cl^{\ominus}$ | 100–102° |
| III/24. | " | 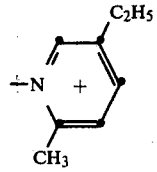 | $Cl^{\ominus}$ | 102–104° |
| III/25. | " | 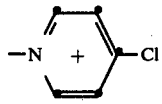 | $Cl^{\ominus}$ | 100–102° |
| III/26. | " | 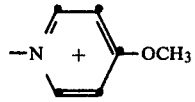 | $Cl^{\ominus}$ | 115–115° |
| III/27. | " | 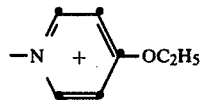 | $Cl^{\ominus}$ | >115° |
| III/28. | " | " | $CiO_4^{\ominus}$ | 112–14° |
| III/29. | " | 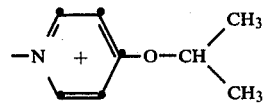 | $Cl^{\ominus}$ | 85–93° |
| III/30. | " | 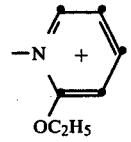 | $Cl^{\ominus}$ | 65–70° |
| III/31. | " | " | $BF_4^{\ominus}$ | 144–43° |

-continued
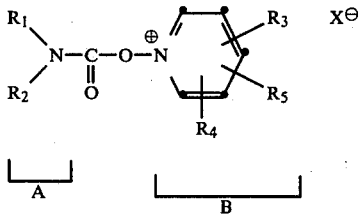
| Subst. Nr. | A | B | $X^{\ominus}$ | Fp. decomp. |
|---|---|---|---|---|
| III/32. | " | 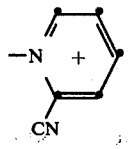 | $Cl^{\ominus}$ | 80–32° |
| III/33. | " | 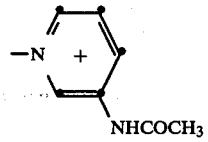 | $ClO_4^{\ominus}$ | 150° |
| III/34. | " | 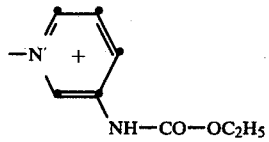 | $ClO_4^{\ominus}$ | 162–65° |
| III/35. | " | 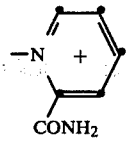 | $ClO_4^{\ominus}$ | 200° |
| III/36. | 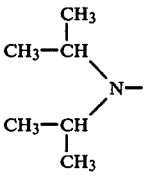 | 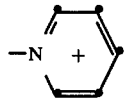 | $Cl^{\ominus}$ | 158° |
| III/37. | " | 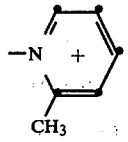 | $Cl^{\ominus}$ | 138° |
| III/38. | " | 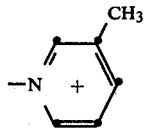 | $Cl^{\ominus}$ | 152–154° |
| III/39. | 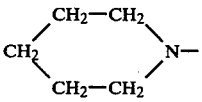 | 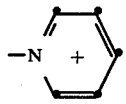 | $Cl^{\ominus}$ | 85–86° |

-continued
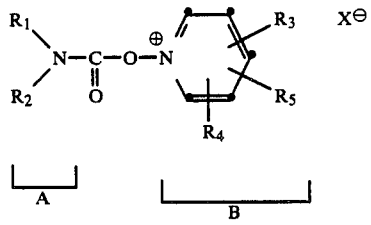
| Subst. Nr. | A | B | X⊖ | Fp. decomp. |
|---|---|---|---|---|
| III/40. | " | 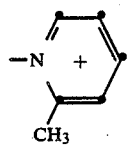 | $ClO_4^{\ominus}$ | 100° |
| III/41. | " | 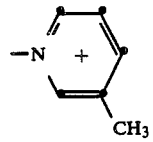 | $ClO_4^{\ominus}$ | 82° |
| III/42. | " | 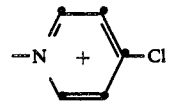 | $Cl^{\ominus}$ | 104–106° |
| III/43. | 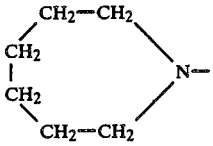 | 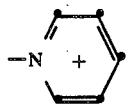 | $Cl^{\ominus}$ | 76–78° |
| III/44. | 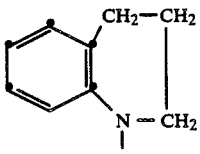 | " | $Cl^{\ominus}$ | 140–144° |
| III/45. | 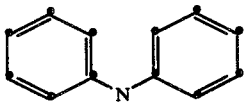 | " | $Cl^{\ominus}$ | 160–162° |
| III/46. | " | 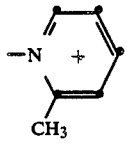 | $Cl^{\ominus}$ | 98–100° |
| III/47. | " | 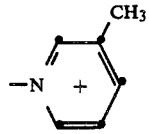 | $Cl^{\ominus}$ | 218–220° |
| III/48. | " | 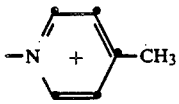 | $Cl^{\ominus}$ | 116° |

-continued
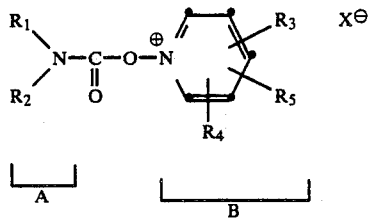
| Subst. Nr. | A | B | X⊖ | Fp. decomp. |
|---|---|---|---|---|
| III/49. | " | 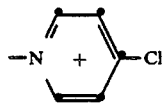 | Cl⊖ | 125–128° |
| III/50. | 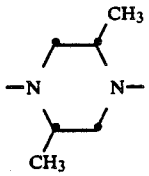 | 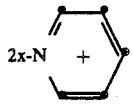 | 2 Cl⊖ | 109–112° |
| III/51. | 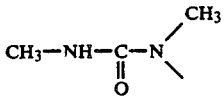 | 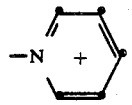 | Cl⊖ | 87–89° |
| III/52. | " | 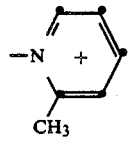 | Cl⊖ | 105° |
| III/53. | " | 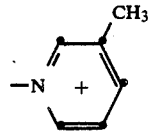 | Cl⊖ | 88–89° |
| III/54. | 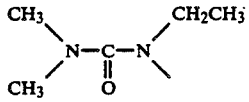 | 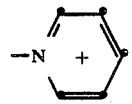 | Cl⊖ | 168–170° |
| III/55. | 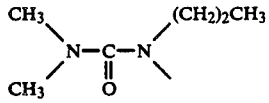 | " | Cl⊖ | 169–175° |
| III/56. | 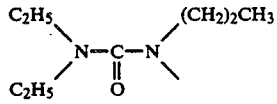 | " | Cl⊖ | 173–180° |
| III/57. | 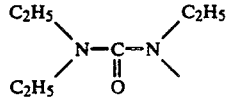 | " | Cl⊖ | 175–183° |
| III/58. | 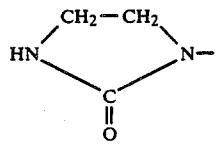 | " | Cl⊖ | 221–225° |

-continued

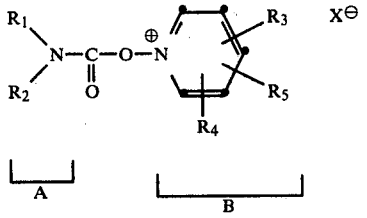

| Subst. Nr. | A | B | $X^{\ominus}$ | Fp. decomp. |
|---|---|---|---|---|
| III/59. | " | 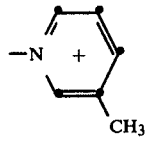 | $Cl^{\ominus}$ | 180–185° |

Compounds according to formula IV

IV/1. $C_2H_5-N=C=N-C_2H_5$
IV/2. $CH_2=CH-CH_2-N=C=N-CH_2-CH=CH_2$
IV/3. $CH_3O-CH_2-CH_2-N=C=N-CH_2-CH_2-OCH_3$

IV/4.

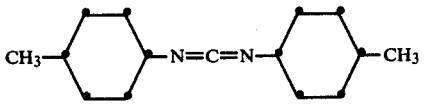

IV/5. $C_2H_5-(CH_3)CH-N=C=N-CH(CH_3)-C_2H_5$
IV/6. $(C_2H_5)_2N-CH_2-CH_2-N=C=N-CH_2-CH_2-N(C_2H_5)_2$

IV/7.

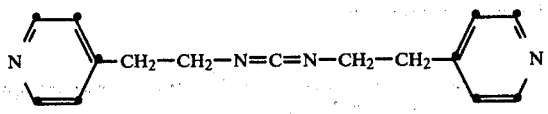

IV/8. $CH_3-N=C=N-CH(CH_3)_2$
IV/9. $C_2H_5-N=C=N-(CH_2)_2-OCH_3$

IV/10.

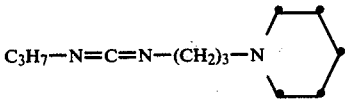

IV/11.

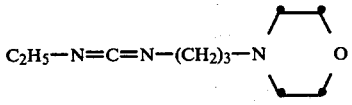

IV/12.

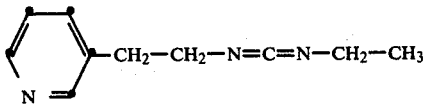

IV/13.

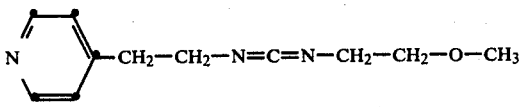

IV/14. $CH_3-N=C=N-(CH_2)_3-\overset{\oplus}{N}(CH_3)_2$ (H) $Cl^{\ominus}$

IV/15. $C_2H_5-N=C=N-(CH_2)_3-\overset{\oplus}{N}(CH_3)_2$ (H) $Cl^{\ominus}$

-continued

IV/16. $C_2H_5-N=C=N-(CH_2)_3-\overset{\oplus}{N}(CH_3)_3$ $Cl^{\ominus}$

IV/17. $C_5H_{11}-N=C=N-(CH_2)_3-\overset{\oplus}{N}(C_2H_5)_2$ (H) $Cl^{\ominus}$ IV/18. 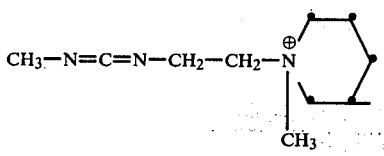 $X^{\ominus}$ IV/19. 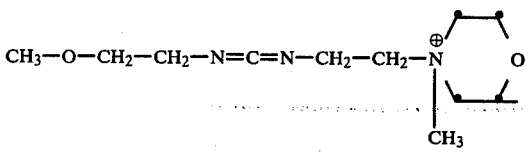 $Cl^{\ominus}$ IV/20. 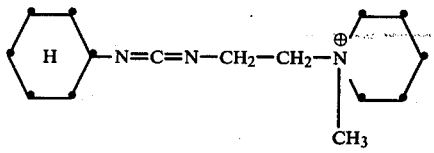 $Cl^{\ominus}$ IV/21. 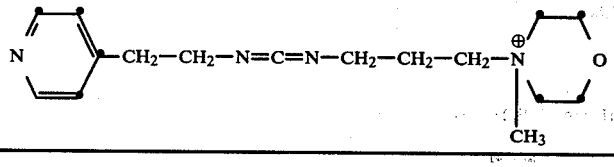 $Cl^{\ominus}$ Compounds according to formula V V/1. $CH_3-N=C=N-(CH_2)_3-\overset{\oplus}{N}(CH_3)_2$ $(CH_2)_4-SO_3^{\ominus}$ V/2. $C_2H_5-N=C=N-(CH_2)_3-\overset{\oplus}{N}(CH_3)_2$ $(CH_2)_4-SO_3^{\ominus}$ V/3. $i.C_3H_7-N=C=N-(CH_2)_3-\overset{\oplus}{N}(CH_3)_2$ $(CH_2)_4-SO_3^{\ominus}$ V/4. 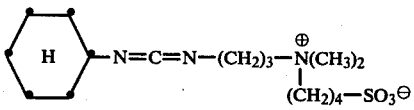

V/5. $CH_3-N=C=N-(CH_2)_3-\overset{\oplus}{N}(C_2H_5)_2$ $(CH_2)_4-SO_3^{\ominus}$ V/6. $C_2H_5-N=C=N-(CH_2)_3-N(C_2H_5)_2$ $(CH_2)_4-SO_3^{\ominus}$ V/7. $i-C_3H_7-N=C=N-(CH_2)_3-\overset{\oplus}{N}(C_2H_5)_2$ $(CH_2)_4-SO_3^{\ominus}$ -continued V/8. 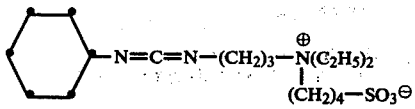

V/9. 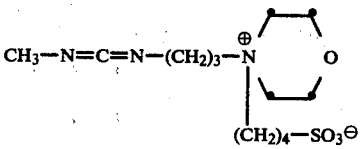

V/10. 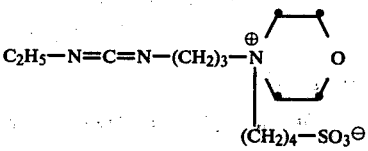

V/11. $CH_3-N=C=N-(CH_2)_3-\overset{\oplus}{N}(CH_3)_2$ $(CH_2)_3-SO_3^{\ominus}$ V/12. $CH_3-N=C=N-(CH_2)_3-\overset{\oplus}{N}(CH_3)_2$ $CH_3-CH_2$ $CH_2-CH-SO_3^{\ominus}$ V/13. $CH_3-N=C=N-(CH_2)_3-\overset{\oplus}{N}(CH_3)_2$ $CH_2-SO_3^{\ominus}$ -continued

V/14.

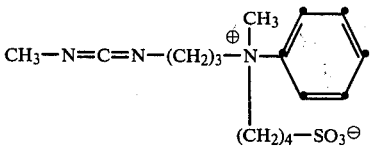

V/15.

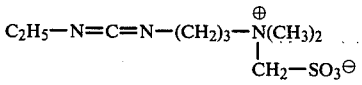

V/16.

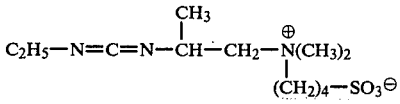

V/17.

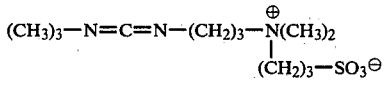

V/18.

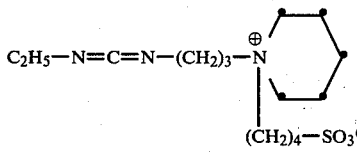

-continued

V/19.

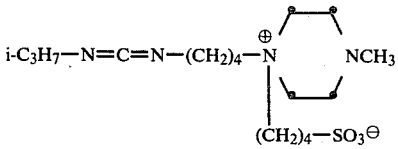

V/20.

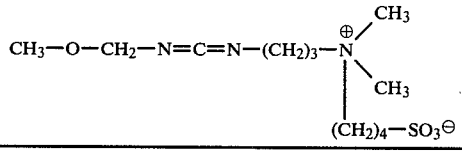

Compounds according to formula VI

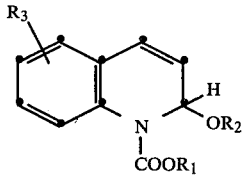

| Nr. | $R_1$ | $R_2$ | $R_3$ | Bp. (°C.) | Fp. (°C.) |
|---|---|---|---|---|---|
| VI/1. | $CH_3$ | $CH_3$ | H | 130°(0,3) | |
| VI/2. | $C_2H_5$ | $C_2H_5$ | H | | 64–66° |
| VI/3. | $CH_3$ | $C_2H_5$ | H | | 75–76° |
| VI/4. | $C_2H_5$ | $CH_3$ | H | 135–140°(0,6) | |
| VI/5. | $CH_3$ | $(CH_2)_2.CH_3$ | H | 135–140°(0,3) | |
| VI/6. | $CH_3$ | $CH.(CH_3)_2$ | H | 135–140°(0,3) | |
| VI/7. | $CH_3$ | $(CH_2)_2.OCH_3$ | H | 180–185°(0,4) | |
| VI/8. | $CH_3$ | $(CH_2)_2.OC_2H_5$ | H | 162–168°(0,6) | |
| VI/9. | $CH_3$ | $(CH_2)_2.SO_2.CH_3$ | H | not distillable oil | |
| VI/10. | $CH_3$ | $(CH_2)_2.SO_2.C_2H_5$ | H | not distillable oil | " |
| VI/11. | $CH_3$ | $(CH_2)_2.Cl$ | H | 135–150°(0,5) | |
| VI/12. | $CH_3$ | $(CH_2)_2.N^{\oplus}(CH_3)_3Cl^{\ominus}$ | H | | |
| VI/13. | $C_2H_5$ | $(CH_2)_2.CH_3$ | H | 140–145°(1,0) | |
| VI/14. | $C_2H_5$ | $CH.(CH_3)_2$ | H | 130–134°(0,5) | |
| VI/15. | $C_2H_5$ | $(CH_2)_2.OCH_3$ | H | 160–165°(0,25) | |
| VI/16. | $C_2H_5$ | $(CH_2)_2.OC_2H_5$ | H | 175–180°(0,25) | |
| VI/17. | $C_2H_5$ | $CH_2.C_6H_5$ | H | 180–185°(0,15) | |
| VI/18. | $C_2H_5$ | $(CH_2)_2.C_6H_5$ | H | 180–190°(0,15) | |
| VI/19. | $C_2H_5$ | $(CH_2)_2.SO_2.CH_2CH_3$ | H | viscous oil | |
| VI/20. | $C_2H_5$ | $(CH_2)_2.Cl$ | H | 135–145°(0,5) | |
| VI/21. | $C_2H_5$ | $(CH_2)_2.N^{\oplus}(CH_3)_3Cl^{\ominus}$ | H | | 140° (decomp.) |
| VI/22. | $C_2H_5$ | $(CH_2)_3.CH_3$ | H | 137–139°(0,5) | |
| VI/23. | $(CH_2)_2.OCH_3$ | $CH_3$ | H | 175–180°(0,3) | |
| VI/24. | $(CH_2)_2.OCH_3$ | $(CH_2)_2.OCH_3$ | H | 180–185°(0,3) | |
| VI/25. | $C_2H_5$ | $C_2H_5$ | (5)$SO_3Na$ | Sirup | |
| VI/26. | $C_2H_5$ | $C_2H_5$ | (8)$OCH_3$ | 160(0,5) | |

Compounds according to formula VII

VII/1.

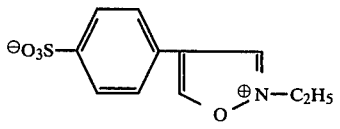

VII/2.

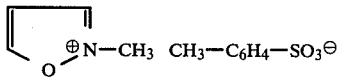

-continued

VII/3.

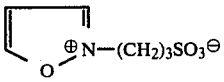

VII/4.

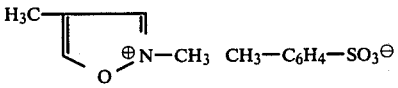

VII/5.

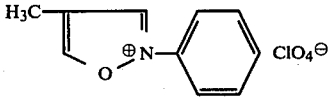

VII/6.

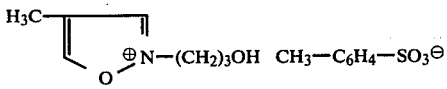

VII/7.

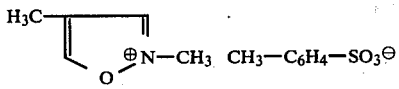

VII/8.

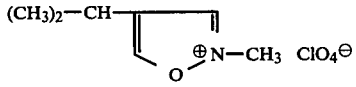

VII/9.

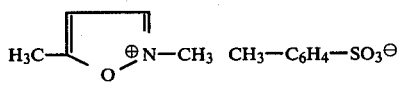

VII/10.

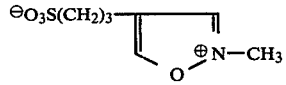

Compounds according to formula VIII

VIII/1.

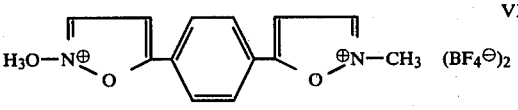

VIII/2.

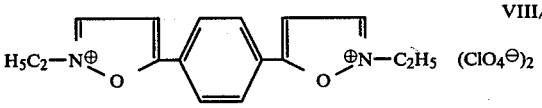

VIII/3.

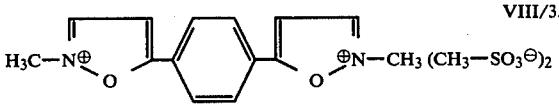

VIII/4.

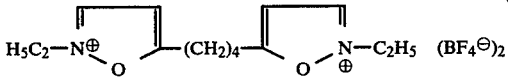

VIII/5.

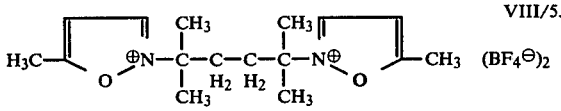

-continued

VIII/6.

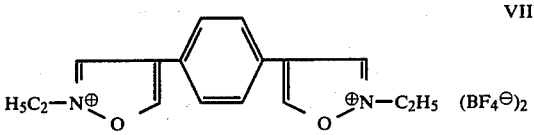

Compounds according to formula IX

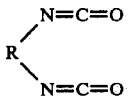

| Nr. | R |
|---|---|
| IX/1. | $-(CH_2)_6-$ |
| IX/2. | 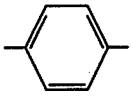 |
| IX/3. | 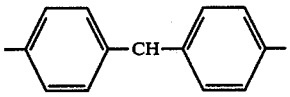 |
| IX/4. | 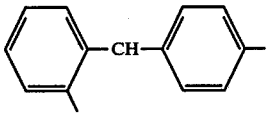 |
| IX/5. | 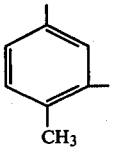 |
| IX/6. | 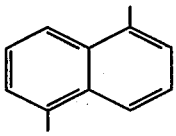 |

The fast acting hardening agents which are suitable for the process of the invention are known per se. Details concerning their preparation and properties can be obtained from the following publications. Carbamoylonium compounds from British Pat. No. 1,383,630 and carbamoyloxy pyridinium compounds from Belgian Pat. No. 825,726. Carbodiimide hardeners are described in U.S. Pat. Nos. 2,938,892 and 3,098,693 and in the work of E. Schmidt, F. Hitzler and E. Lahde in Ber. 71, 1933 (1938) or of G. Amiard and R. Heynes in Bull. Soc. Chim. France 1360 (1956), as well as in Belgian Pat. No. 830,866. Details concerning suitable dihydroquinoline compounds can be found in British Pat. No. 1,452,669. Isoxazolium salts and bis-isoxazoles are described for example in U.S. Pat. Nos. 3,316,095; 3,321,313; 3,543,292 and 3,681,372 or in British Pat. No. 1,030,882.

The chain-lengthened gelatines of the invention are particularly suitable for use as binding agents for producing photographic layers. They can be used both unmixed and in admixture with the gelatine generally used for photographic purposes. The range of mixing ratios is practically unlimited and can easily be adapted to a particular use. By a photographic gelatine is understood in this connection the gelatines which are described in, for example, Ullmanns Encyclopaedia of Technical Chemistry, 3rd Edition 13 volume, pages 620 and 621; H. W. Woods's paper I. Photo. Sci. 9, 151 (1961); W. S. Wittenberg's work: Photo-Technik and Wirtschaft, 11, (1960), 279, or in R. J. Croome and F. G. Clegg's work "Photographic Gelatine", Focal Press London-New York 1965.

By photographic layers, in the present connection are understood quite generally layers which can be used in photographic materials, for example light-sensitive silver halide emulsion layers, protective layers, filter layers, anti-halation layers, backing layers, or photographic auxiliary layers in general.

The light-sensitive emulsion layers, for which the process according to the invention is particularly suitable include for example those layers which are based on unsensitized emulsions, X-ray emulsions and other spectrally sensitized emulsions. Also, the gelatines of the invention are suitable for the production of the gelatine layers which are used for the various black and white and colour photographic processes, such as negative, positive, and diffusion transfer processes or reproduction processes. The gelatines of the invention have proved to be particularly advantageous in the production of multilayer photographic materials which are intended for carrying out colour photographic processes, e.g. those with emulsion layers which contain colour couplers or emulsion layers which are intended for treatment with solutions which contain colour couplers.

As light-sensitive components, the emulsion layers may contain any known silver halides, such as silver chloride; silver iodide; silver bromide; silver iodobromide; silver chlorobromide or silver chloroiodobromide. The emulsions can be chemically sensitized by precious metal compounds, e.g. by compounds of ruthenium, rhodium, palladium, iridium, platinum or gold, such as ammonium chloropalladate, potassium chloroplatinate, potassium chloropalladite or potassium chloroaurate. They can also contain special sensitizing agents of sulphur compounds, tin(II) salts, polyamines or polyalkylene oxide compounds. Furthermore, the emulsions can be optically sensitized e.g. by cyanine dyes, merocyanine dyes and mixed cyanine dyes.

Finally, the emulsions can contain a variety of water-soluble couplers or emulsified couplers which are insoluble in water, colourless couplers, coloured couplers and stabilizers, such as mercury compounds, triazole compounds, azaindenecompounds, benzothiazolium compounds or zinc compounds; wetting agents, such as dihydroxyalkane; agents for improving the characteristics of film production, e.g. the high molecular weight polymers which form particles and can be dispersed in water, obtained from the emulsion polymerisation of alkyl acrylate mixed polymers or alkyl methacrylate/acrylic acid mixed polymers or methacrylic acid mixed polymers, styrene-maleic acid-mixed polymers or styrene-maleic acid anhydride hemi alkyl ester-mixed polymers, auxiliary agents, such as polyethlene glycol lauryl ether, as well as a wide variety of photographic additives.

As hydrophilic colloids, the following can be used in the layers in addition to the modified gelatine: colloidal albumin, agar, gum arabic, dextran alginic acid, cellulose derivatives, e.g. cellulose acetate hydrolyzed to an acetyl content of 19 to 26%, polyacrylamides, imidized polyacrylamides, zein, vinyl alcohol polymers with urethane/carboxylic acid groups or cyano acetyl groups, such as vinyl alcohol vinyl cyanoacetate-mixed polymers, polyvinyl alcohols, polyvinyl pyrrolidones, hydrolyzed polyvinyl acetates, polymers which are obtained in the polymerisation of proteins or saturated acylated proteins with monomers with vinyl groups; polyvinyl pyridines, polyvinyl amines, polyaminoethyl methacrylates and polyethylene imines.

The photographic layers produced by using the gelatines of the invention can be hardened in the usual way e.g. with hardening agents, as is described in the journal "Research Disclosure", Industrial Opportunities Ltd., Homewell, Havant, Hampshire, England, December 1978, page 26 under (X). It is shown by this method that the gelatines of the invention, compared to conventional gelatines, require approximately 30% less hardening agent.

The gelatines of the invention can advantageously be used other than for photographic processes. The characteristics obtained by the chain-lengthening make the gelatine in addition extremely suitable for use in cosmetics, for the production of gelatine capsules or gelatine membranes, and for use in foodstuffs.

EXAMPLE 1–12

Using the hardening agents specified in the following table, twelve gelatine samples were produced in the following manner:

A 25% by weight aqueous solution of an alkaline ashed bone gelatine was prepared at 50° C., by stirring vigorously with the specified amount, according to the table, of the appropriate hardening agent, per 100 g gelatine in aqueous solution. After a few seconds, the cross-linking reaction took place and the solution hardened. The jelled solution was gelatinized at room temperature for a few hours. The crushed gel was mixed with the amount of water necessary to produce a 5% by weight solution and was stirred at 50° C. until it dissolved completely.

Using the 5% solutions of the different gelatines, the following measurements were carried out:

1. viscoelastometer

The solution was cooled from 40° C. to 20° C. within a time of 2 seconds in a viscoelastomer. In this apparatus, the viscosity and elasticity of the solution were measured as a function of time.

The time which elapses after adjusting the temperature to 20° C., until the rigidity modulus of the solution has reached a value of 30 Pa is shown in the following as incubation time t. As a comparison, the incubation time of the starting gelatine was also determined as $t^o$. In the table, as a measurement of the acceleration in setting the factor $t_o/t$ is given.

2. Viscosity

The viscosity was determined with an Ubbelohde Viscometer at 40° C. in the 5% gelatine solutions. As a measurement of the increase in the viscosity, in the table the quotient $\eta/\eta_o$ is given, in which $\eta$ represents the viscosity of the treated gelatine and $\eta_o$ represents the viscosity of the starting gelatine.

3. Microgel Fraction

The molecular weight distributions were determined by means of gel chromatography in aqueous solutions buffered with potassium acetate. The method is described in the journal Colloid & Polymer Sci., Vol 252

(1974), pages 949 to 970. The molecular fraction found in the exclusion volume (molecular weights $10\times10^6$ g/mole) is defined as the microgel fraction.

TABLE 2

Examples 1-12

| Example No. | Hardener | Amount of hardener per 100 g gelatine | Addition of Na—dodecyl sulphate. | $t_o/t$ | $\eta/\eta_o$ | Proportion of microgel |
|---|---|---|---|---|---|---|
| 1. | I/12 | 3 m Mole | 4% | 3.1 | 3 | 30% |
| 2. | I/19 | 3 m Mole | 4% | 2.8 | 3.1 | 25% |
| 3. | II/15 | 0.6 g | — | 1.3 | 2.0 | n.m |
| 4. | II/15 | 0.6 g | 4% | 3.2 | 4.7 | 38% |
| 5. | II/15 | 0.8 g | — | 2.5 | 3.1 | n.m |
| 6. | III/15 | 3 m Mole | 4% | 2.9 | 3.4 | 25% |
| 7. | IV/16 | 3 m Mole | — | 3.2 | 3.5 | 30% |
| 8. | V/2 | 0.6 g | — | 3.1 | 4 | 32% |
| 9. | VI/2 | 0.6 g | — | 2.4 | 2.9 | n.m |
| 10. | VII/7 | 3 g | — | 2.0 | 1.5 | n.m |
| 11. | VIII/2 | 5 g | — | 1.8 | 1.3 | n.m |
| 12. | IX/1 | 0.6 g | — | 3.1 | 4.1 | n.m |

n.m. = not measured

EXAMPLE 13

A low grade gelatine (the last extract of a bone gelatine) was pre-processed as in example 7 and was examined for rate of setting and gel strength.

As a measure of the gel firmness, the rigidity modulus is given which the 5% by weight aqueous gelatine reaches after a very long time. This value $G_\infty$ is calculated by extrapolation to $t\rightarrow\infty$. It is proportional to the Bloom-Value. The Bloom-Value is measured by first of all cooling a 6.66% by weight aqueous gelatine solution in a Bloom glass for 16 hours at 10° C. The measuring is carried out by pressing a stamp with a diameter of 12.7 mm, 4 mm down into the gel. The weight in grams, which is necessary to impress this stamp the specified distance, is called the Bloom-Value.

The rigidity modulus ($G_\infty$) and the incubation time $t_o$ of solutions of the following gelatines were measured (5% by weight aqueous solutions):

(A) The last extract of an alkaline ashed boned gelatine;

(B) =A, with 0.8% by weight of the carbodiimide 1V/16, previously cross-linked in 25% by weight aqueous solution at 50° C.:

(C) =A, with 1.6% by weight of the carbodiimide 1V/14, previously cross-linked in 25% by weight aqueous solution at 50° C.:

(D) Untreated high grade bone gelatine.

The following results were obtained:

| | $G_\infty$ (N/m$^2$) | $t_o$ (sec) |
|---|---|---|
| A | 154 | 459 |
| B | 239 | 261 |
| C | 347 | 99 |
| D | 810 | 72 |

The rate of hardening of a last extract of an alkaline ashed bone gelatine is increased by the preprocessing according to the invention by a factor of 4.6.

The rigidity modulus $G_\infty$ is increased by a factor 2.3.

The comparison with the setting time $t_o$ of a high grade gelatine (D) shows that, with the sample (C) according to the invention, which originated from a lower quality gelatine, a rate of setting was achieved which is comparable to that of a high grade gelatine.

EXAMPLE 14

A low grade gelatine (the last extract of a skin gelatine) was pre-processed as in example 8 and its rate of setting and gel firmness were measured.

The rigidity modulus ($G_\infty$) and the incubation time $t_o$ of solutions of the following gelatines were measured:

(A) The last extract of an alkaline ashed skin gelatine (B) =A, with 0.8% by weight of the carbodiimide V/2, previously cross-linked in 25% by weight aqueous solution at 50° C.:

(C) =A, with 1.6% by weight of the carbodiimide V/2, previously cross-linked in 25% by weight aqueous solution at 50° C.

The following results were obtained:

| | $G_\infty$ (N/m$^2$) | $t_o$ (sec) |
|---|---|---|
| A | 43 | 1915 |
| B | 151 | 491 |
| C | 258 | 131 |

The rate of gelation of a last extract of an alkaline ashed skin gelatine is increased through the pre-processing according to the invention by the factor 14.

The rigidity modulus $G_\infty$ is increased by the factor 6.

The comparison with un-processed high grade gelatine from example 13 (D) shows that the rate of gelation of the samples according to the invention, which are based on a lower grade gelatine, was considerably increased and was practically brought to the level of a high grade gelatine.

EXAMPLE 15

Characterization of the swelling behaviour.

Layers were cast on a casting machine from solutions of the starting gelatine and of the gelatine produced as in Example 8 and were dried at two different web temperatures.

1. 15° C. web temperature=cold drying
2. 30° C. web temperature=hot drying

Half of the layers were hardened in the usual manner by covering with layers of the aqueous solution of the fast hardening agent of example 8. The solution contained 4% by weight of the compound V/2. 1.08 g hardener per m$^2$ (27 g gelatine/m$^2$) were applied. The hardening was measured by the swelling factor (S.F.) The swelling factor is the ratio of the thickness of a layer in a swelled and air-dried condition. It is measured on layers which stick on a bed. The swelling took place in distilled water for 5 minutes at 20° C.

The lateral swelling (so called A-Value) was also determined in the layers produced in this way. The A-Value is the percentage surface increase of a layer where the swelling is undisturbed, in distilled water for 3 minutes at 20° C.

$$A\text{-Value} = \left(\frac{F}{F_o} - 1\right)\cdot 100$$

F: Surface of the swelled layer:

$F_o$: Surface of the dried layer.

It is known that higher drying temperatures cause higher lateral swellings.

The following A-Values (lateral swelling) and SF. (swelling factor) were measured.

| | Cold drying | | | | Hot drying | | | |
|---|---|---|---|---|---|---|---|---|
| | unhardened | | hardened | | unhardened | | hardened | |
| Sample | A | S.F. | A | S.F. | A | S.F. | A | S.F. |
| I | 261 | 23.1 | 52 | 4.4 above | 643 | 12.0 | 231 | 4.7 |
| II | 31 | 9.1 | 33 | 3.8 | 168 | 5.9 | 123 | 3.9 |

Sample 1: Untreated comparison gelatine from example 8.

Sample 11: Chain lengthened gelatine from example 8.

The example shows that the gelatine 11 pre-processed according to the invention, when it has been dried by cold drying, has a very low A-Values, which is practically unchanged by hardening. After hot drying, the A-Value of the unhardened gelatine 11 is just below that of the hardened gelatine 1 and a relatively small reduction is produced by hardening.

The low A-Values which are obtained by the pre-cross-linking, cause the tendency towards reticulation of semi finished materials to be reduced or avoided in the further manufacture of the material.

EXAMPLE 16

Using a skin gelatine and a gelatine produced from this according to example 4 (compound 11/15), samples of 5% casting solutions were cast. The wet application amounted to 100 μm, the casting rate was 70 m/min. Setting was carried out at 15° C. for 16 to 0 seconds; subsequently, drying was carried out at a material temperature of 19° C. with an air velocity of 26 m/sec., and the casting quality was judged with regard to vesiculation.

The following table shows the results obtained:

| Setting time | Skin gelatine | Gelatine according to the invention |
|---|---|---|
| 16s | no reticulation | no reticulation |
| 12s | slight reticulation | no reticulation |
| 8s | heavy reticulation | no reticulation |
| 4s | very heavy reticulation | no reticulation |
| 0s | very heavy reticulation | slight reticulation |

Accordingly, the setting time of the gelatine according to the invention is also greatly improved under practical conditions.

EXAMPLE 17

The following layers are applied successively on to a cellulose triacetate substrate provided with an adhesion layer;

1. An antihalation layer which contains 4 g gelatine and 0.7 g colloidal black silver per m².
2. A 6μ thick red-sensitive layer which contains per m², 35 m Mole silver halide (95% AgBr, 5% AgI), 4 mMole of a cyan coupler according to the formula;

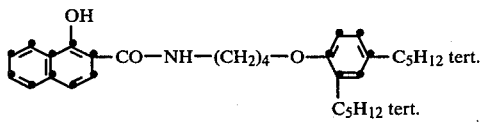

and 6 g gelatine,

3. A 0.5μ thick gelatine intermediate layer,
4. A 6μ thick green-sensitive layer which corresponds to that of layer 1, which contains as a magenta coupler the compound:

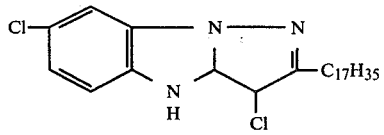

5. A 0.5μ thick gelatine intermediate layer,
6. A yellow filter layer which contains, per m², 1.5 g gelatine and 0.2 g of colloidal yellow silver,
7. A 6μ thick blue-sensitive layer which contains per m² —mMole silver halide (95% AgBr, 5% AgI), 2 mMole of a yellow coupler according to

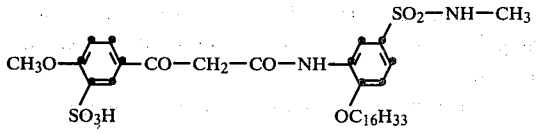

and 5 g gelatine and

8. A 1μ thick gelatine protective layer.

Onto the layer 8, an aqueous solution of the hardening agent according to the formula:

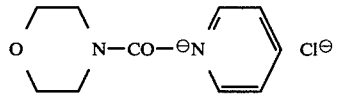

is finally applied in a quantity of 0.6 g hardening agent per m² and the material is subsequently dried.

The production of the material is repeated with the difference that in the gelatine layers 1 to 8, the gelatine is replaced by the chain lengthened gelatine of example 1.

A photographic material is obtained which in its quality is in no way inferior to the material produced by using the usual photographic gelatine, and which is superior in production to the conventional material, because of its advantageous setting characteristics and the increased viscosity of the chain-lengthened gelatine.

We claim:

1. In a process for chain-lengthening gelatin for a photographic material by an agent or agents to provide increased molecular weight, the steps comprising preparing a gelatin solution containing from 5 to 35% by weight of gelatin, contacting said gelatin solution for a period of 0.01 seconds to 10 minutes at 30° to 90° C. with 0.001 to 0.01 mole of an agent per 100 g of dry gelatin, said agent being capable of activating the carboxyl groups of the gelatin with the formation of reactive products causing cross-linking, and thereby providing chain-lengthening of the molecules of the gelatin resulting in a change of the distribution of the molecular weight within said gelatin solution by producing intercaternary bonds and linear chain-lengthening to increase the molecular weight of the gelatin derivative and in the absence of decreasing triple helix formation, said chain-lengthened gelatin solution being coatable into a layer on a support, said chain-lengthening agent being capable of converting a photographic gelatin layer resistant to boiling after treatment of a 20μ thick dry gelatin layer with an aqueous solution of the agent at a concentration of 0.01 to 0.03 mole chain-lengthening agent per 100 g dry gelatin at a pH value of the moist gelatin layer of 5 to 7 at a temperature of 20° C.

2. A process as claimed in claim 1 in which the hardening agent is a carbamoylonium compound, a carbamoyloxypyridinium compound, a carbodiimide, a sulphobetaine carbodiimide, an isoxazolium salt, a bis-isooxazole or a quaternary salt thereof, or a diisocyanate.

3. A process as claimed in claim 1 or claim 2 in which the gelatine solution contains at least 10% by weight of gelatine.

4. A process as claimed in claim 3 in which the gelatine solution contains from 10 to 30% by weight of gelatine.

5. A process as claimed in any of claims 1 or 2 in which the gelatine solution is contacted with from 0.002 to 0.008 mole of agent per 100 g of gelatine.

6. A process as claimed in any of claims 1 or 2 in which the gelatine solution is contacted with the agent for a reaction time of from 5 to 200 seconds.

7. A process as claimed in claim 6 in which the reaction time is 7 to 100 seconds.

8. A process as claimed in any of claims 1 or 2 in which the gelatine solution is contacted with the agent at a temperature of from 30° to 60° C.

9. A process as claimed in any of claims 1 or 2 in which the gelatine solution is contacted with the agent in the presence of a surface active compound.

10. A process as claimed in claim 9 in which the surface-active compound is sodium dodecyl sulphate.

11. A chain-lengthening gelatine which has been produced by a process as claimed in any of claims 1 or 2.

12. A gelatine mixture which comprises a photographic quality gelatine and an effective quantity of a gelatine as claimed in claim 11.

13. A photographic material comprising a substrate and a chain lengthened gelatine as claimed in claim 11 or a gelatine mixture as claimed in claim 12.

* * * * *

UNITED STATES PATENT AND TRADEMARK OFFICE

CERTIFICATE OF CORRECTION

PATENT NO. : 4,421,847

DATED : December 20, 1983

INVENTOR(S) : JUNG ET AL

It is certified that error appears in the above-identified patent and that said Letters Patent are hereby corrected as shown below:

Col. 2, line 67, "poly" should read --only--;

Col. 4, last line, "Bu" should read --By--;

Col. 5, line 13, "ineversibly" should read --irreversibly--;

Col. 7, line 56, "piperdine" should read --piperidine--;

Col. 42, line 47, "viscoelastomer" should read --viscoelastometer--

Col. 42, line 54, "$t^0$" should read --$t_0$--;

Col. 43, line 60, "hardening" should read --setting--;

Col. 45, line 15, "A-Values" should read --A-Value--.

Signed and Sealed this

Ninth Day of October 1984

[SEAL]

Attest:

GERALD J. MOSSINGHOFF

Attesting Officer

Commissioner of Patents and Trademarks